US010773865B2

(12) United States Patent
Strachan

(10) Patent No.: US 10,773,865 B2
(45) Date of Patent: Sep. 15, 2020

(54) CONTAINER WITH VENTING FEATURES

(71) Applicant: FIRST QUALITY PACKAGING SOLUTIONS, LLC, Great Neck, NY (US)

(72) Inventor: Mark Strachan, Jupiter, FL (US)

(73) Assignee: FIRST QUALITY PACKAGING SOLUTIONS, LLC, Great Neck, NY (US)

( * ) Notice: Subject to any disclaimer, the term of this patent is extended or adjusted under 35 U.S.C. 154(b) by 0 days.

(21) Appl. No.: 15/642,144

(22) Filed: Jul. 5, 2017

(65) Prior Publication Data

US 2018/0016066 A1 Jan. 18, 2018

Related U.S. Application Data

(60) Provisional application No. 62/363,740, filed on Jul. 18, 2016.

(51) Int. Cl.

| | |
|---|---|
| ***B65D 47/32*** | (2006.01) |
| ***B65D 43/02*** | (2006.01) |
| ***B65D 1/34*** | (2006.01) |
| ***B65D 51/16*** | (2006.01) |

(52) U.S. Cl.

CPC ..... *B65D 47/32* (2013.01); *B65D 1/34* (2013.01); *B65D 43/0208* (2013.01); *B65D 51/1611* (2013.01); *B65D 51/1627* (2013.01); *B65D 2543/005* (2013.01); *B65D 2543/0062* (2013.01); *B65D 2543/00194* (2013.01); *B65D 2543/00296* (2013.01); *B65D 2543/00351* (2013.01); *B65D 2543/00509* (2013.01); *B65D 2543/00537* (2013.01); *B65D 2543/00555* (2013.01); *B65D 2543/00629* (2013.01); *B65D 2543/00685* (2013.01); *B65D 2543/00694* (2013.01); *B65D 2543/00731* (2013.01); *B65D 2543/00768* (2013.01); *B65D 2543/00796* (2013.01)

(58) Field of Classification Search

CPC .... B65D 47/32; B65D 51/16; B65D 51/1611; B65D 51/1605; B65D 51/1622; B65D 51/1627; B65D 51/1661; B65D 51/1666; B65D 51/1688; B65D 51/1694; B65D 1/34; B65D 43/06; B65D 43/08; B65D 81/263; B65D 81/34; B65D 81/343; B65D 81/3446; B65D 81/3453

USPC ..... 220/374, 367.1, 366.1, 785, 373, 580, 220/203.03, 227, 303, 368, 912, 913, 747, 220/573.1

See application file for complete search history.

(56) References Cited

U.S. PATENT DOCUMENTS

| | | | | |
|---|---|---|---|---|
| 3,741,427 A * | 6/1973 | Doyle | A47J 36/022 | 126/377.1 |
| 4,276,990 A * | 7/1981 | Chiodo | B65D 51/1666 | 220/203.12 |
| 4,609,126 A * | 9/1986 | Janda | H02B 7/06 | 174/16.1 |

(Continued)

*Primary Examiner* — Robert Poon

(74) *Attorney, Agent, or Firm* — Amster, Rothstein & Ebenstein LLP

(57) ABSTRACT

A container including a base and a lid that is releasably attached to the base. The lid includes a channel that extends around a perimeter of the lid. At least one inlet opening provides fluid communication between an interior of the container and the channel, and at least one outlet opening provides fluid communication between the channel and atmosphere.

7 Claims, 10 Drawing Sheets

(56) References Cited

U.S. PATENT DOCUMENTS

| | | | | |
|---|---|---|---|---|
| 5,947,321 | A * | 9/1999 | Vadney | B65D 51/1611 220/326 |
| 6,488,173 | B2 * | 12/2002 | Milan | A47G 19/2272 215/387 |
| 6,711,989 | B1 * | 3/2004 | Sarnoff | A47J 36/022 220/573.1 |
| 2004/0118852 | A1 * | 6/2004 | Barmore | B65D 77/2044 220/359.2 |
| 2008/0254170 | A1 * | 10/2008 | Darin | A23B 7/148 426/118 |
| 2009/0117245 | A1 * | 5/2009 | Peyrat | A47J 37/01 426/523 |
| 2011/0068105 | A1 * | 3/2011 | Pohlman | B65D 51/1666 220/366.1 |

* cited by examiner

CONTAINER WITH VENTING FEATURES

RELATED APPLICATIONS

This application is based on and claims priority to U.S. Provisional Application 62/363,740, filed Jul. 18, 2016, the contents of which are incorporated herein by reference in their entirety.

FIELD OF THE INVENTION

The present disclosure generally relates to containers, and in particular to containers that have venting features.

BACKGROUND

Many different designs of packages are already in use at food markets, such as delis and grocery stores, for the purpose of displaying and transporting of roasted whole or portioned meats, such as roasted chickens and ribs, to name a few. All of these containers include venting features that allow the hot moisture (steam) to escape from the package. This venting is important as it prevents the chicken from becoming soggy and assists with the crisping of the chicken.

Most roasted chicken (or other types of meat) packages include venting features, such as venting slots or holes in the top surface of the lid or venting slots between the lid and the base. Vent slots in the surface of the lid present contamination concerns and the venting slots between the matching surfaces of the lid and the base have a tendency to leak oil and chicken broth when the package is tilted during transport. Also, the packages currently used in the industry offer no element of insulation from the high heat radiating from the chicken and fluids to the outside surface of the package, making it virtually impossible for the consumer to hold the package for extended periods of time.

SUMMARY OF THE INVENTION

An object of the present invention is to provide a container that effectively vents steam without the use of vent slots in the upper surface of the container lid through the use of side vents between the lid and base and a unique venting feature in the lid.

Another object of the present invention is to allow for cold ambient air to be drawn in to the container at flange vents and for escape of hot air from the container to control the stored food moisture level.

The flange venting feature of the present invention allows steam and moisture to leave the enclosed compartment and channels it to the opposite end of the package, thereby providing a buffer in the event any oils or fluids escape along with the steam.

The flange venting features provide a more sanitary option to vent slots in the surface of the lid and also offer a means to prevent spills when the container is being transported.

The optional addition of dome lid vents strategically placed at corners of the lid prevents blockage of escaping heat and moisture due to roasters being stacked one upon each other A container according to an exemplary embodiment of the present invention comprises: a base; and a lid that is releasably attached to the base, the lid comprising a channel that extends around a perimeter of the lid, at least one inlet opening that provides fluid communication between an interior of the container and the channel, and at least one outlet opening that provides fluid communication between the channel and atmosphere.

In an exemplary embodiment, the base comprises a flange and the lid comprises a flange, and the channel is defined by a separation between the base flange and the lid flange that forms an open path around the perimeter of the lid.

In an exemplary embodiment, portions of the base flange and the lid flange other than the separated portions that define the channel are in direct contact with one another.

In an exemplary embodiment, the inlet opening is defined by a pocket formed in the lid flange below the channel.

In an exemplary embodiment, the outlet opening is defined by an elongated pocket formed in the lid flange above the channel.

In an exemplary embodiment, the lid further comprises additional outlet openings that provide direct fluid communication between the interior of the container and atmosphere.

In an exemplary embodiment, the base is made of a multi-layer sheet comprising an inner foamed layer.

In an exemplary embodiment, the base is made of a single layer sheet.

Other features and advantages of embodiments of the invention will become readily apparent from the following detailed description and the accompanying drawings.

DESCRIPTION OF THE DRAWINGS

The features and advantages of exemplary embodiments of the present invention will be more fully understood with reference to the following, detailed description when taken in conjunction with the accompanying figures, wherein.

DETAILED DESCRIPTION

Figure 1:
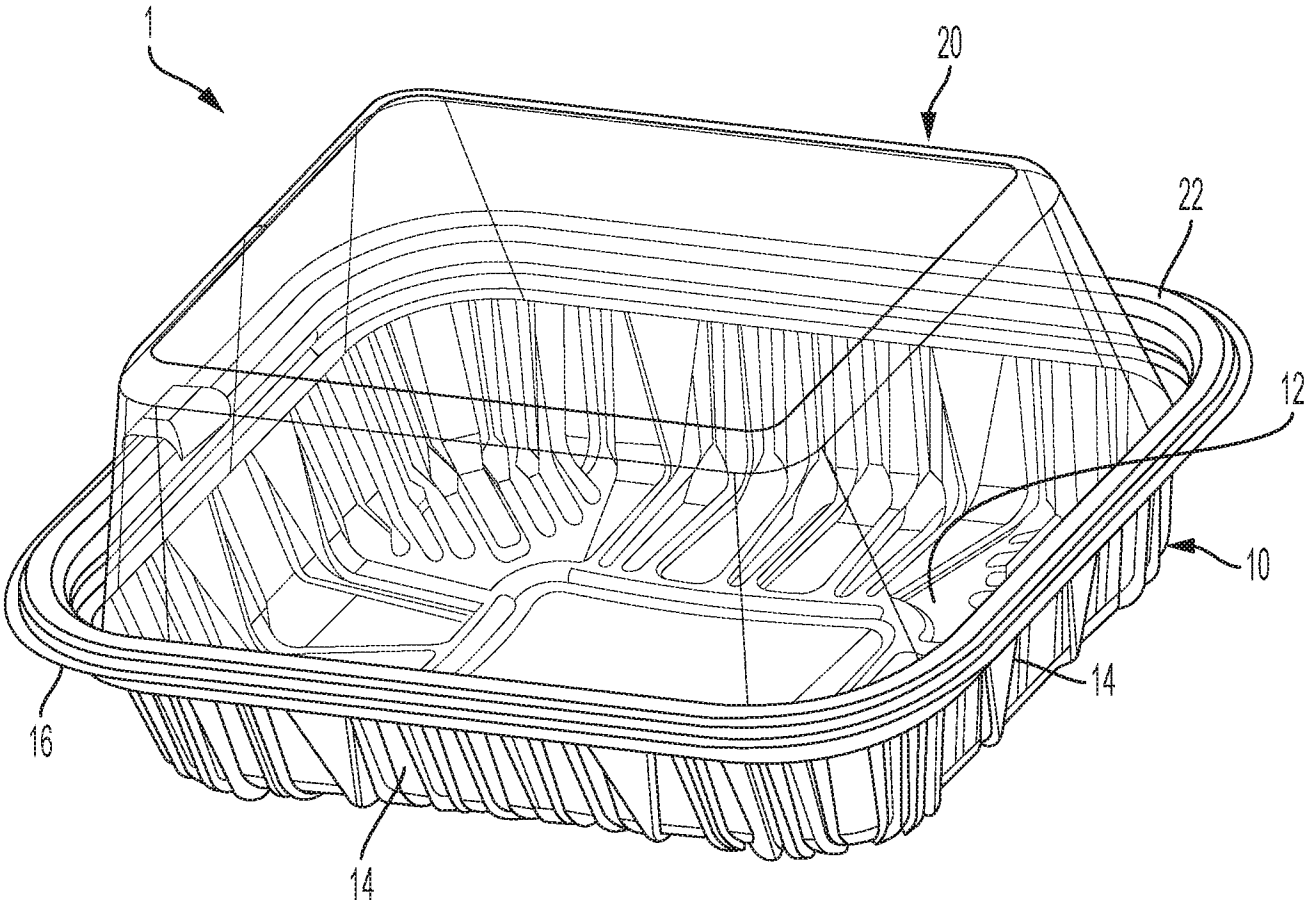
FIG. 1 is a perspective view of a container according to an exemplary embodiment of the present invention.

The headings used herein are for organizational purposes only and are not meant to be used to limit the scope of the description. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

FIG. 1 is a perspective view of a container, generally designated by reference number 1, according to an exemplary embodiment of the present invention. The container 1 includes a base 10 having a bottom wall 12 and side walls 14. The bottom wall 12 and side walls 14 define an opening 12 through which roasted chicken or other food items may be passed for storage within the container 1. The container 1 also includes a lid 20 that is configured to be releasably fixed to the base 10 and enclose the opening 12. In this regard, the base 10 includes a flange 16 around the opening 12 that is configured to engage with a complementary flange 22 around the periphery of the lid 20 by interference fit. Although the container 1 is shown in FIG. 1 as having a rectangular shape, it should be appreciated that the container 1 and its base and lid components may have any other suitable shape, such as circular, oval or square.

Figure 2:
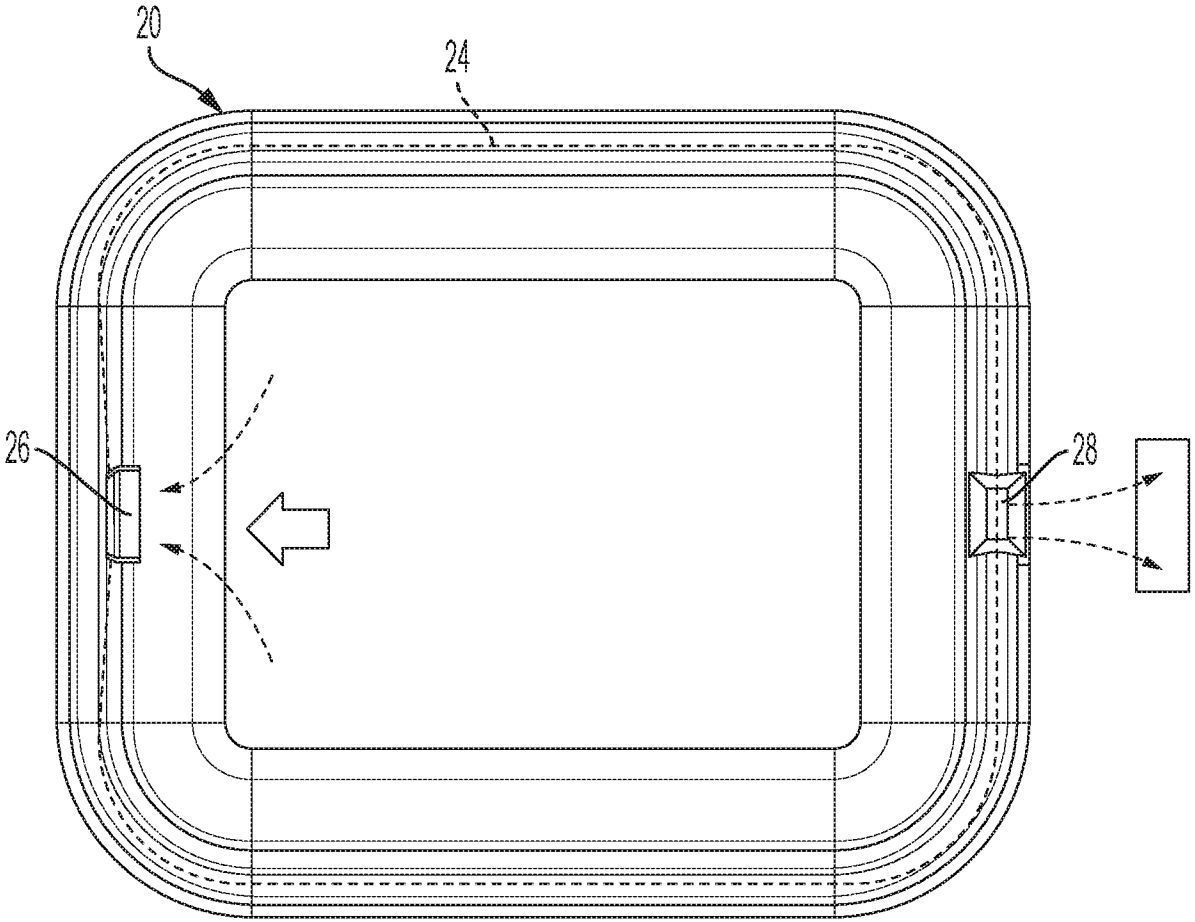
FIG. 2 is a top plan view of a lid according to an exemplary embodiment of the present invention.

FIG. 2 is a top plan view of the lid 20. The lid 20 includes a channel 24, indicated by a dashed line, that extends around the perimeter of the lid 20. The lid 20 further includes an inlet opening 26 through which hot air/steam is vented into the channel 24 and out from the interior of the container 1 and an outlet opening 28 through which the hot air/steam is vented out of the channel 24 to atmosphere. As explained further herein, the channel 24 functions as a buffer around the perimeter of the lid 10 and base 20 so that liquids will not leak from the closed container 1, even when the container 1 is tipped excessively. The channel 24 catches any liquid that flows out of the base 20 and into the inlet opening 26, while allowing the hot air and steam to escape through the outlet opening 28. Although the inlet and outlet openings 26, 28 are shown positioned at opposite side walls, it should be appreciated that the openings may be positioned at any point along the perimeter of the lid 10.

Figure 3A:
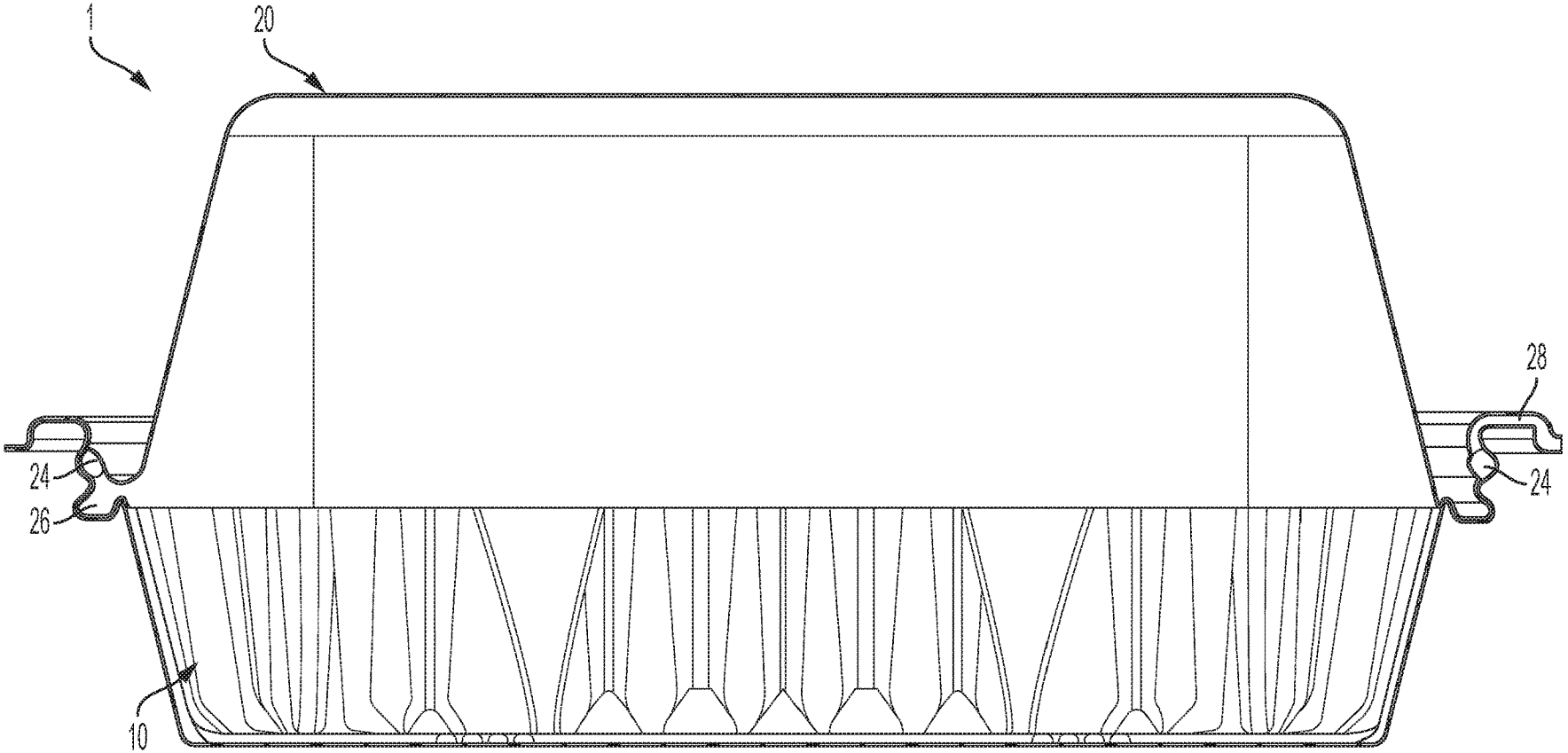
FIGS. 3A-3C are cross sectional views of a lid according to an exemplary embodiment of the present invention.
Figure 3B:
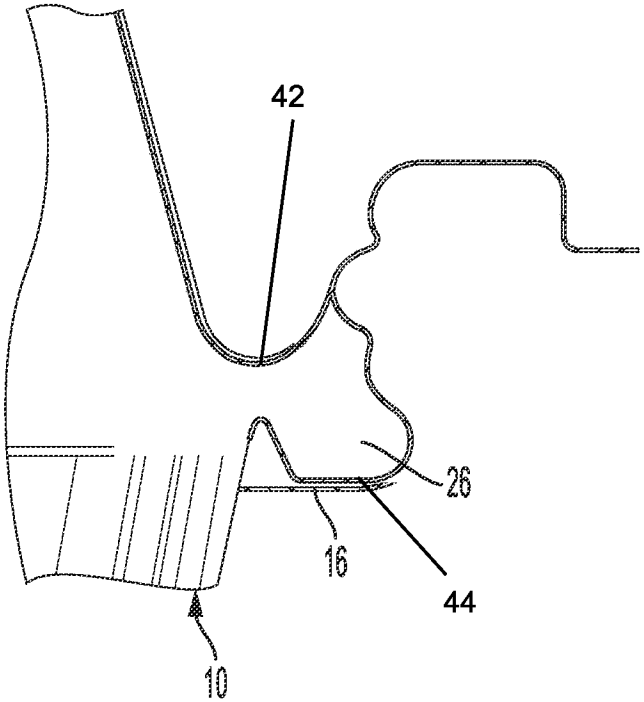
Figure 3C:
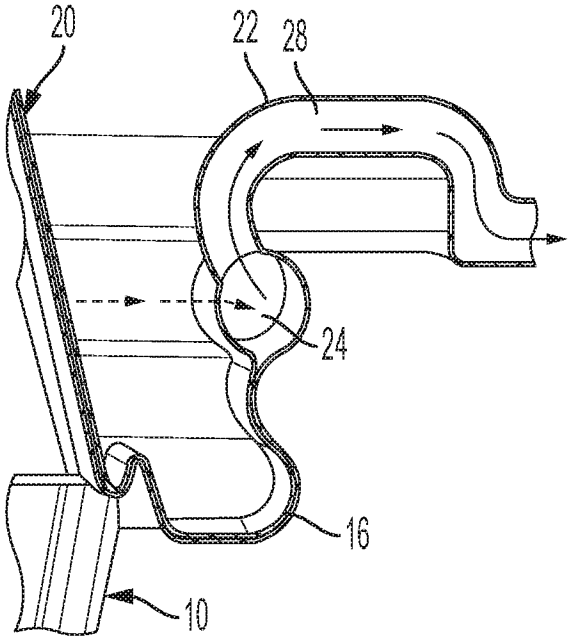

FIGS. 3A-3C are cross-sectional views of the container 1 showing in detail the channel 24, the inlet opening 26 and the outlet opening 28. The general profile of the flange 16 of the base 10 matches that of the flange 22 of the lid 20 except where the flanges 16, 22 separate to form the channel 24. That is, the base 10 and lid 20 are sealed around the perimeter of the container 1 except at the channel 24, so that any fluid escaping from the container 1 tends to follow the path defined by the channel 24.

Figure 4:
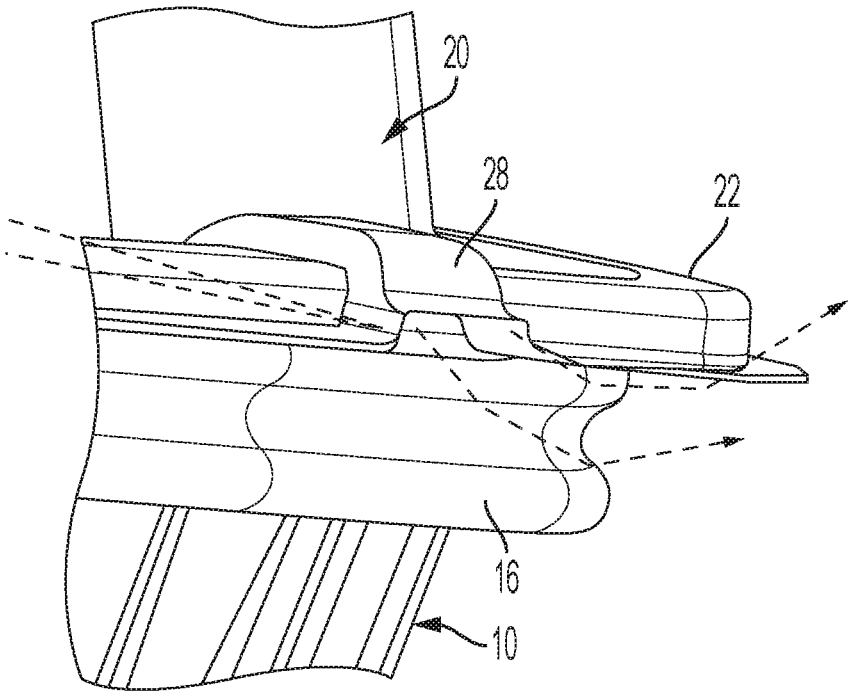
FIG. 4 is a perspective view of an outlet opening of a lid according to an exemplary embodiment of the present invention.

Further, as shown in greater detail in FIG. 3B, the flange 22 of the lid 20 includes a first pocket that defines the inlet opening 26 that is in fluid communication with the enclosed space of the container 1 and the channel 24. The inlet opening 26 is further defined by a top flange wall 42 and a bottom flange wall 44 of the flange 22 of the lid 20. The inlet opening 26 is disposed below the channel 24 so that liquid does not tend to enter the channel 24 and potentially escape through the outlet opening 28. At the same time, hot air and steam is able to escape through the inlet opening 26 and into the channel 24, for eventual release through the outlet opening 28. FIG. 4 is a perspective view of the outlet opening 28, showing the hot air and steam (indicated by dashed lines) escaping from the interior of the container 1 through the channel 24.

As shown in greater detail in FIG. 3C, the flange 22 of the lid 20 includes a second pocket that defines the outlet opening 28. The outlet opening 28 is disposed above the channel 24 so that any liquid within the channel 24 will be less inclined to escape through the outlet opening 28. At the same time, the hot air and steam that entered the channel 24 through the inlet opening 26 is released through the outlet opening 28.

Figure 5:
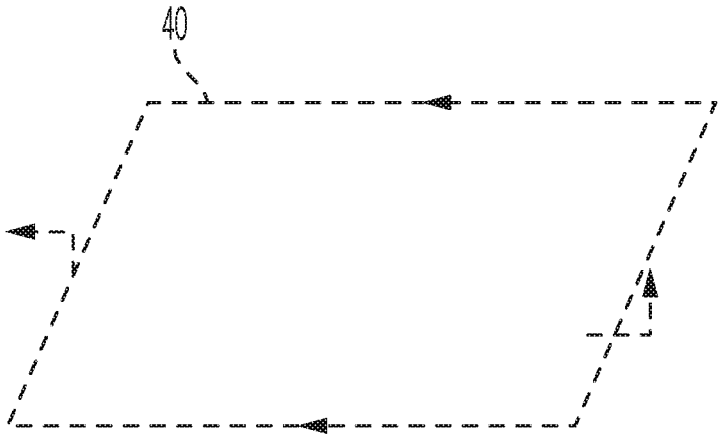
FIG. 5 illustrates a circuitous path formed by a lid according to an exemplary embodiment of the present invention.

In general, as shown in FIG. 5, the combination of the inlet opening 26, the outlet opening 28 and the channel 24 defines a circuitous path 40 that acts as a buffer in minimizing or eliminating any escape of liquid from the interior of the container 1 while allowing gases in the form of hot air and steam to vent out.

Figure 6:
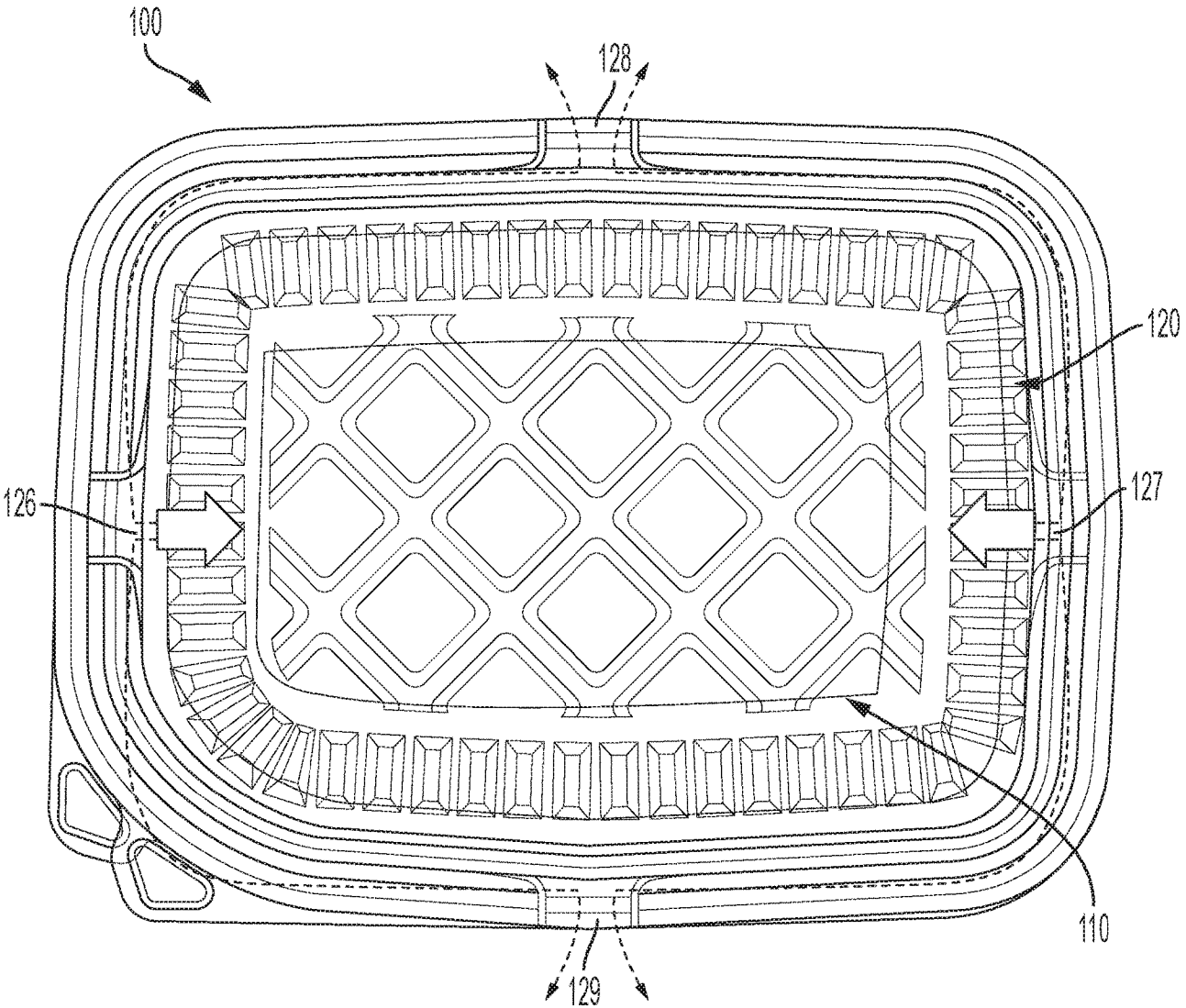
FIG. 6 is a top view of a container according to an exemplary embodiment of the present invention.

FIG. 6 is a top view of a container, generally designated by reference number 100, according to another exemplary embodiment of the present invention. The container 100 has the same general configuration as the container 1, except that in this embodiment the container 100 includes two inlet opening and two outlet openings. In particular, the lid 120 of the container 100 includes first and second inlet openings 126, 127 disposed at opposite side walls of the container 100, and first and second outlet openings 128, 129 disposed at the other opposite side walls of the container 100. As in the previous embodiment, the container 100 also includes a base 110.

Figure 7:
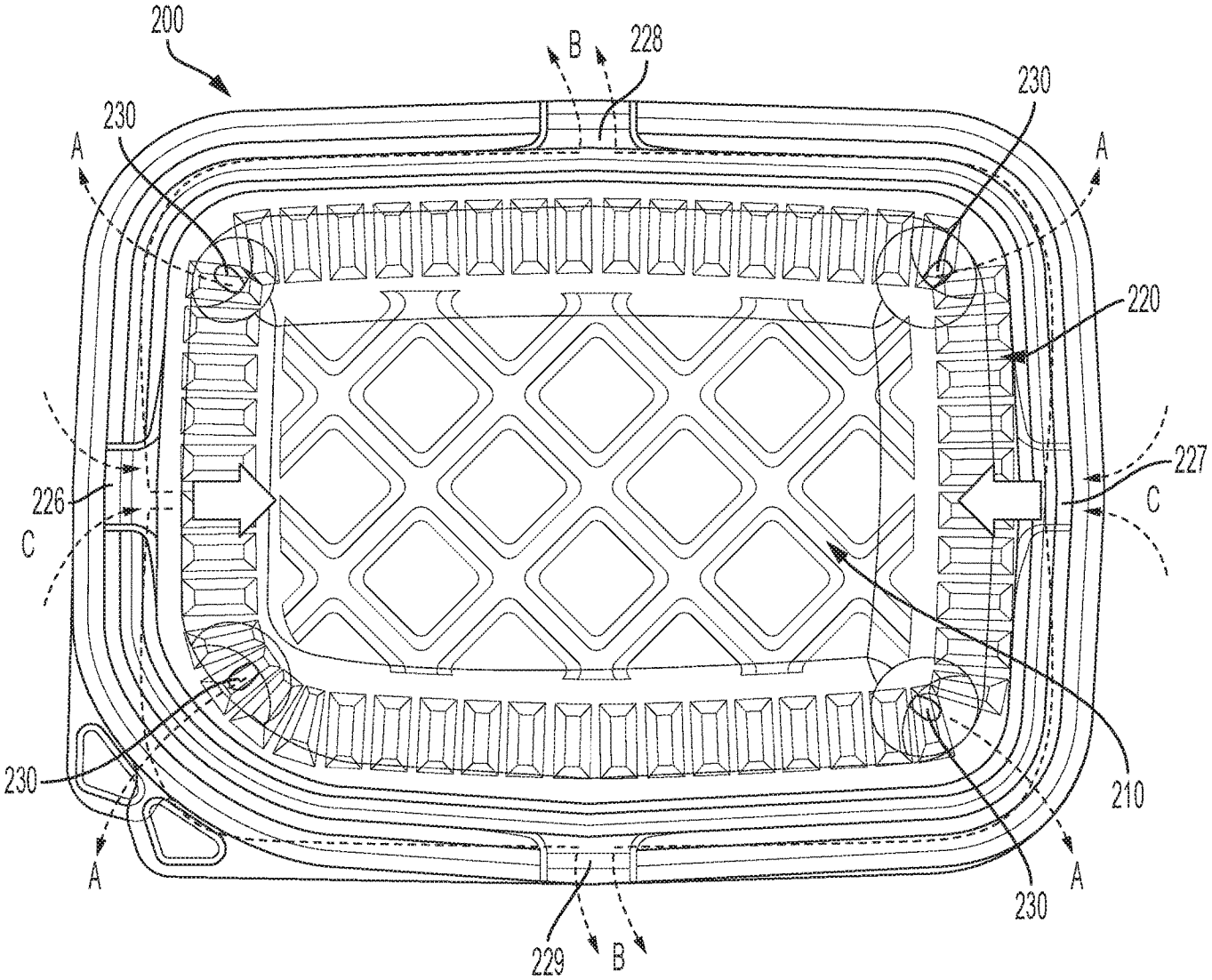
FIG. 7 is a top view of a container according to an exemplary embodiment of the present invention.

FIG. 7 is a top view of a container, generally designated by reference number 200, according to another exemplary embodiment of the present invention. The container 200 has the same general configuration as the container 100, except that additional outlet openings are provided on the top of the lid 220. In particular, the lid 220 of the container 200 includes first and second inlet openings 226, 227 disposed at opposite side walls of the container 200, first and second outlet openings 228, 229 disposed at the other opposite side walls of the container 200 and additional outlet openings 230 formed at the upper corners of the lid 220. The venting configuration in this embodiment allows relatively cooler ambient air to be pulled in and the hot air and steam to be vented out through the first and second outlet openings 228, 229. The additional outlet openings 230 are located below the top surface of the lid 220 so that they are not blocked when another container is placed on top of the lid 220 and also to prevent contamination from nested containers.

Figure 8:
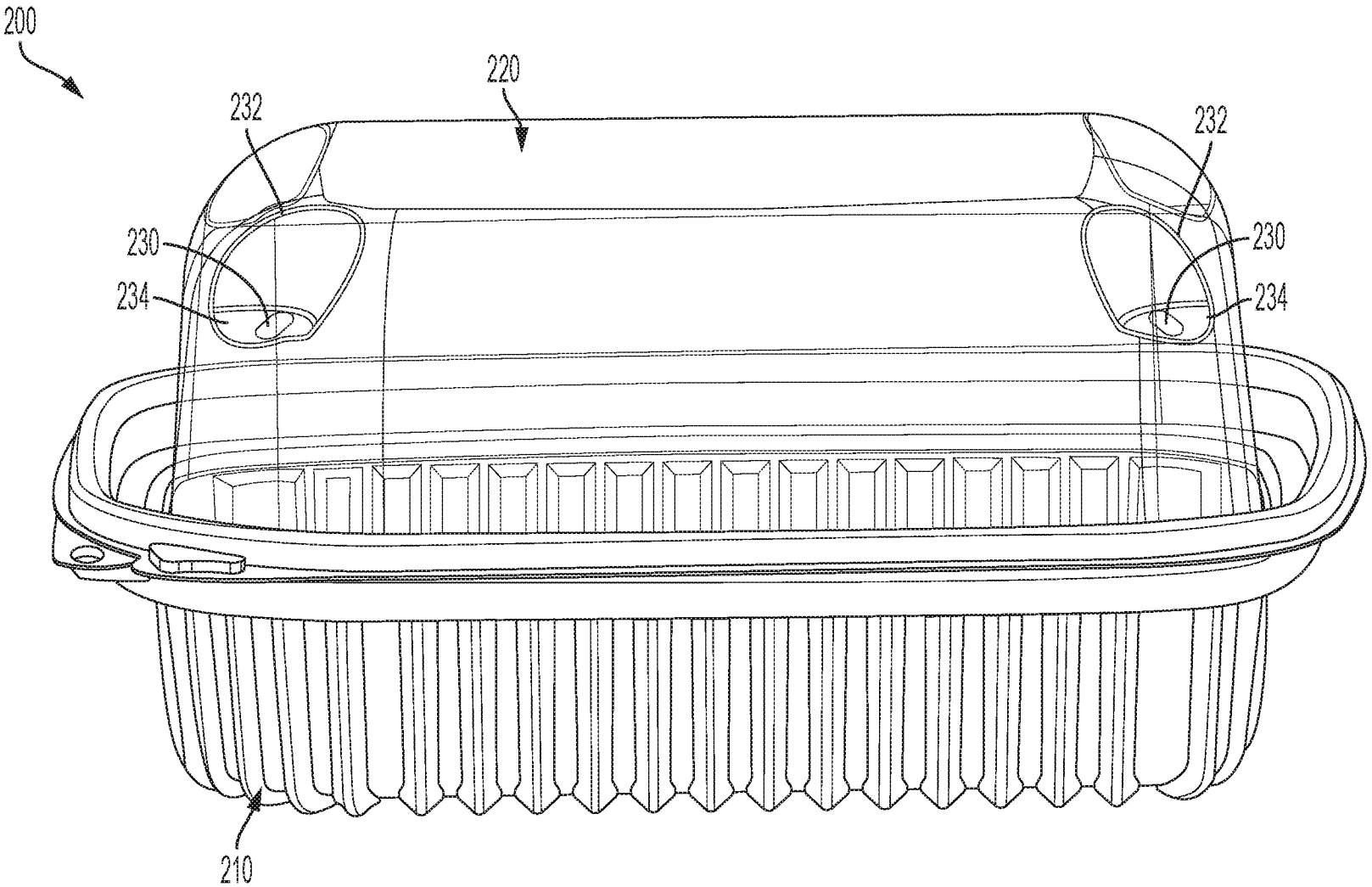
FIG. 8 is a perspective view of the container of FIG. 7.

FIG. 8 is a perspective view of the container 200 showing the additional outlet openings 230 in more detail. Specifically, indentations 232 are formed at the corners of the lid 210, and each indentation includes a flat surface 234 that is generally parallel with the bottom wall 212 of the base 210, although in other embodiments one or more of the flat surfaces 234 may be angled relative to the bottom wall 212. Each additional outlet openings 230 is defined in a corresponding one of the flat surfaces 234. This configuration of the additional openings 230 provides additional venting of hot air and steam while only allowing liquid to escape if the container 1 is turned completely upside down. Specifically, when a hot food item is placed in the container 200 and the lid 220 snapped in place, steam is first released through the additional outlet openings 230 and then, as the contents cool down, a vacuum is created in the container causing air to be sucked through the first and second outlet openings 228, 229 along with other contaminants. However, the channels extending between the first and second outlet openings 228, 229 and the first and second inlet openings 226, 227 minimizes the possibility of contaminants reaching the food item because of the distance the contaminants would need to travel. Although FIG. 8 shows four additional outlet openings 230, it should be appreciated that there is no limitation on the number of additional openings.

The base 10, 110, 210 is preferably made of a multi-layer sheet that includes an inner foamed layer and outer layers made of polypropylene. The inner foamed layer may be made of industrial polypropylene regrind, pre and/or post consumer polypropylene regrind, recycled plastics or a combination of these materials. The lid 20, 120, 220 may be made of polypropylene. In exemplary embodiments, the polypropylene used for the base and lid may be replaced or used in combination with PET or APET (polyethylene terephthalate), HIPS (high impact polystyrene), PLA (polylactic acid), HDPE (high density polyethylene), LDPE (low density polyethylene) and other thermoformable plastics.

Figure 9:
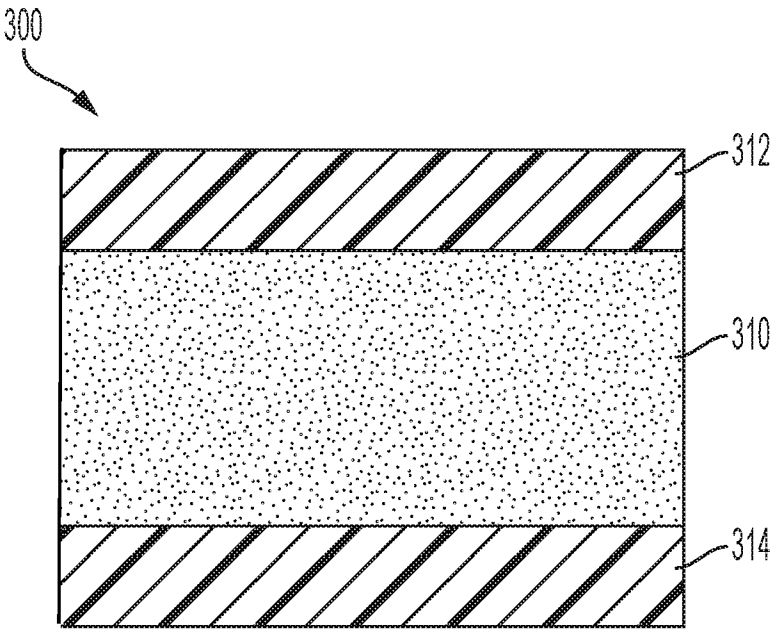
FIG. 9 is a cross-sectional view of a sheet used to form a base portion of a container according to an exemplary embodiment of the present invention.

As shown in FIG. 9, in an exemplary embodiment, the base 10, 110, 210 is made of a multi-layer sheet 300 including an internal foamed layer 310 and external layers 312, 314 made of virgin polypropylene. The external layers 312, 314 include color or pigment, such as black or red coloring, to make the base opaque. The internal foamed layer 310 is made of polypropylene with Talc or CaCO fillers. The thickness of the internal foamed layer 310 may take up 80% to 90% of the entire thickness of the base, with the remaining thickness taken up by the external layers 312, 314. The foamed internal layer provides a degree of thermal insulation for the consumer carrying the packaged product.

While in the foregoing specification a detailed description of specific embodiments of the invention was set forth, it will be understood that many of the details herein given may be varied considerably by those skilled in the art without departing from the spirit and scope of the invention.

The invention claimed is:

1. A container comprising:

a base;

a lid that is releasably attached to the base; and a channel that extends around a perimeter of the lid, the lid comprising:

a top wall;

side walls extending downwards from the top wall, the side walls forming a flange, the flange comprising a top flange wall and a bottom flange wall;

at least one inlet opening disposed in one of the sidewalls of the lid between the top flange wall and the bottom flange wall that provides fluid communication between an interior of the container and the channel; and at least one outlet opening that provides fluid communication between the channel and atmosphere.

2. The container of claim 1, wherein the base comprises a flange, and the channel is defined by a separation between the base flange and the lid flange that forms an open path around the perimeter of the lid.

3. The container of claim 2, wherein portions of the base flange and the lid flange other than the separated portions that define the channel are in direct contact with one another.

4. The container of claim 1, wherein the outlet opening is defined by an elongated pocket formed in the lid above the channel.

5. The container of claim 1, wherein the lid further comprises additional outlet openings that provide direct fluid communication between the interior of the container and atmosphere.

6. The container of claim 1, wherein the base is made of a multi-layer sheet comprising an inner foamed layer.

7. The container of claim 1, wherein the base is made of a single layer sheet.

* * * * *